US010598457B2

(12) United States Patent
Maga

(10) Patent No.: US 10,598,457 B2
(45) **Date of Patent: *Mar. 24, 2020**

(54) SIDE-LOADING FIXED MAGAZINE WITH SLIDING AMMUNITION LOADING COVER AND SINGLE-SIDE RETRACTABLE FOLLOWER

(71) Applicant: David D. Maga, Castaic, CA (US)

(72) Inventor: David D. Maga, Castaic, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/784,078

(22) Filed: Oct. 13, 2017

(65) Prior Publication Data

US 2018/0292153 A1 Oct. 11, 2018

Related U.S. Application Data

(60) Provisional application No. 62/483,814, filed on Apr. 10, 2017, provisional application No. 62/483,822,
(Continued)

(51) Int. Cl.
*F41A 9/65* (2006.01)
*F41A 17/38* (2006.01)
(Continued)

(52) U.S. Cl.
CPC ..... *F41A 17/38* (2013.01); *F41A 9/67* (2013.01); *F41A 9/82* (2013.01)

(58) Field of Classification Search
CPC ..... F41A 9/65; F41A 9/67; F41A 9/83; F41A 9/71; F41A 17/38
(Continued)

(56) References Cited

U.S. PATENT DOCUMENTS 1,797,951 A * 3/1931 Gaidos ..... F41A 9/67 42/50
2,477,936 A 8/1949 Molins et al.
(Continued)

FOREIGN PATENT DOCUMENTS

WO 2009032742 A1 3/2009

OTHER PUBLICATIONS

Website Link: https://www.armaglock.com/ Downloaded Jan. 12, 2017 AR-15 Fixed Magazine.
(Continued)

*Primary Examiner* — Michael D David
(74) *Attorney, Agent, or Firm* — Roland J. Tong; Manning & Kaas Ellrod Ramirez Trester LLP

(57) ABSTRACT

A fixed magazine in compliance with new firearms laws that enables citizens to legally own and effectively operate a firearm, such as an AR-15. The fixed magazine allows a user to easily load ammunition through a side of the fixed magazine without removing the magazine from the firearm, disassembling the action, or using tools. The fixed magazine includes: an extension portion configured to contain a stack of cartridges, and an attachable blocking tab for blocking removal of the ammunition magazine from the magazine well, the attachable blocking tab being attached after insertion of the ammunition magazine into the magazine well, and before re-engaging the upper receiver with the lower receiver. The fixed magazine also includes a cartridge-loading portion having a side opening, with a cover configured to alternately cover or reveal the opening, and a follower compartment including: a finger-pull slot with a bottom hook for locking the follower.

15 Claims, 9 Drawing Sheets

Related U.S. Application Data filed on Apr. 10, 2017, provisional application No. 62/483,827, filed on Apr. 10, 2017.

(51) Int. Cl.
*F41A 9/67* (2006.01)
*F41A 9/82* (2006.01)

(58) Field of Classification Search
USPC ..... 42/50, 49.01, 18, 87
See application file for complete search history.

(56) References Cited

U.S. PATENT DOCUMENTS 2,585,738 A 2/1952 Chapin et al.
2,908,987 A 10/1959 Allyn
3,005,279 A 10/1961 Brewer
4,430,821 A 2/1984 Vincent
4,502,237 A * 3/1985 Krogh ..... F41A 9/70 42/50
4,588,240 A 5/1986 Ruehl et al.
4,614,052 A 9/1986 Brown et al.
4,688,344 A 8/1987 Kim
4,707,941 A * 11/1987 Eastman ..... F41A 9/68 42/49.02
5,278,690 A 1/1994 Vella-Coleiro
5,461,811 A 10/1995 Ciener
5,697,179 A * 12/1997 Vanmoor ..... F41A 9/65 42/50
5,806,224 A 9/1998 Hager
6,212,815 B1 * 4/2001 Fitzpatrick ..... F41A 9/65 224/196
6,311,603 B1 11/2001 Dunlap
6,481,136 B1 11/2002 Fitzpartick
6,739,082 B2 5/2004 Christensen
6,807,764 B1 * 10/2004 Phillips ..... F41A 9/83 42/87
7,162,824 B1 1/2007 McCormick
7,444,775 B1 11/2008 Schuetz
7,497,044 B2 3/2009 Cammenga et al.
7,941,955 B2 5/2011 Stone
8,316,567 B2 * 11/2012 Douglas ..... F41A 9/67 42/50
8,418,390 B1 4/2013 Wright
8,720,095 B2 * 5/2014 Wright ..... F41A 9/65 42/50
8,756,845 B2 6/2014 Harris et al.
9,103,614 B2 * 8/2015 Froehle ..... F41A 9/67
9,121,652 B1 9/2015 Mangiameli
9,303,934 B1 * 4/2016 Kazsuk ..... F41A 9/83
9,341,421 B2 5/2016 Findlay
9,395,130 B2 7/2016 Jacobson
9,482,478 B2 11/2016 Newman
9,683,797 B2 * 6/2017 Boyarkin ..... F41A 9/67
10,288,371 B2 * 5/2019 Maga ..... F41A 17/38
10,295,288 B2 * 5/2019 Maga ..... F41A 17/38
10,302,383 B2 * 5/2019 Maga ..... F41A 17/38
2011/0173858 A1 * 7/2011 Troy ..... F41A 9/65 42/50
2014/0223790 A1 8/2014 Wilson
2015/0096214 A1 * 4/2015 Jones, III ..... F41A 9/71 42/49.01
2015/0276339 A1 * 10/2015 Shreve ..... F41A 9/71 42/50

OTHER PUBLICATIONS

Website Link: http://www.gunauction.com/buy/10420062 Downloaded Jan. 12, 2017 Semi-Auto Rifle Fixed Magazine.
Website Link: https://www.youtube.com/watch?v=F0nnd0Parco Downloaded Jan. 2, 2017 ARMagLock Install By installing an ARMagLock you no longer own a “detachable” magazine firearm. ARMagLock renders your MIL-SPEC AR-15 (and AR-10) a fixed magazine firearm while installed.

* cited by examiner

SIDE-LOADING FIXED MAGAZINE WITH SLIDING AMMUNITION LOADING COVER AND SINGLE-SIDE RETRACTABLE FOLLOWER

CROSS-REFERENCE TO RELATED APPLICATIONS

This application claims priority to three provisional patent applications, i.e., Application No. 62/483,814, Filed Apr. 10, 2017, entitled "Fixed Firearms Magazine Loadable Via a Downward-Sliding Wall"; Application No. 62/483,822, Filed Apr. 10, 2017, entitled "Fixed Firearms Magazine Loadable Via a Downward-Sliding Sleeve"; and Application No. 62/483,827, Filed Apr. 10, 2017, entitled "Fixed Firearms Magazine Loadable Via a Hinged-Door", the entire contents of each being herein incorporated by reference.

FIELD OF INVENTION

This invention relates generally to magazines for use with firearms, and more particularly to magazines that are fixed to a firearm such that the magazine is not removable from the firearm.

BACKGROUND OF THE INVENTION

Firearm laws have been passed in states such as California and New York which require that certain rifles and pistols must be modified to remain legal. In particular, semi-automatic firearms, such as AR-15 rifles and pistols, are being subject to more restrictions, including a prohibition against "detachable magazines". Instead, the California law, for example, requires a "fixed magazine, where "fixed magazine" means an ammunition feeding device contained in, or permanently attached to, a firearm in such a manner that the device cannot be removed without disassembly of the firearm action. Standard semi-automatic firearms have typically been made and sold for use with detachable magazines. In response to the restrictions of the newer firearms laws, semiautomatic firearms are being made and sold with fixed magazines. Further, conversion kits are being sold to convert a firearm with a detachable magazine to a firearm with a fixed magazine. For example, Hager U.S. Pat. No. 5,806,224 teaches a semi-automatic firearm with a non-removable magazine. Also, Stone U.S. Pat. No. 7,941,955 B2 teaches a pivoting, non-detachable magazine. Further, Harris et al. U.S. Pat. No. 8,756,845 B2 teaches method and device for converting a firearm with detachable magazine to a firearm with a fixed magazine.

SUMMARY OF THE INVENTION

By providing a fixed magazine according to the new firearms laws of many states, citizens of those states will be able to legally own a firearm, such as an AR-15.

The fixed magazine of the invention satisfies the new firearms laws, while also being loadable in a way that does not violate the law.

The fixed magazine of the invention is a plastic or metal magazine for centerfire rifles which can be fixed into position so as to become a non-removable magazine, yet it can open while attached to the rifle for easy loading of cartridges.

The method of attachment of the fixed magazine will vary in accordance with the different makes and models of each rifle. The end result of the fixing of the magazine will be compliance with state or local laws, while also facilitating loading of the magazine in a convenient manner.

The fixed magazine of the invention allows a user to easily load the fixed magazine with ammunition without removing the magazine from the firearm, disassembling the action, or using tools. (If this is not legal in your state, a fixed magazine will be provided that requires a tool to open it to load ammunition, but it will open in the same manner as a fixed magazine that does not require a tool.)

A general aspect of the invention is an ammunition magazine for use with a firearm with an upper receiver and a lower receiver, the lower receiver having a magazine well for receiving the ammunition magazine. The ammunition magazine includes: an extension portion configured to contain a stack of cartridges, the extension portion having a loading end and a feeding end, the extension portion including a blocking assembly comprising an attachable blocking tab at the feeding end for blocking removal of the ammunition magazine from the magazine well, the attachable blocking tab being attached after insertion of the ammunition magazine into the magazine well, and before re-engaging the upper receiver with the lower receiver; a cartridge-loading portion configured to accept a sequence of cartridges for loading into the extension portion, the cartridge-loading portion including: an opening, and a cover configured to alternately cover or reveal the opening; a follower compartment including: a finger-pull slot with a bottom hook; and a follower assembly having: a follower, a finger-pull, attached to the follower, the finger-pull extending through the finger-pull slot, the finger-pull being movable when released from the bottom hook, and a spring configured to be compressed by the follower when the finger-pull is engaged with the bottom hook, and configured to expand when the finger-pull is disengaged from the bottom hook, thereby allowing the follower to urge the stack of cartridges towards the feeding end of the ammunition magazine.

In some embodiments, the extension portion is configured to limit capacity of the ammunition magazine to no more than ten cartridges.

In some embodiments, the follower assembly includes: a spring guide, configured to provide support and stability for the spring and to provide alignment for the spring when in an extended position and when in a compressed position, the spring guide having a shape that fits inside the follower when the spring is in the compressed position; and a follower arm, fixedly attached to the finger-pull, with the follower arm also configured to flexibly attach to the follower, so as to allow movement of the finger-pull into the bottom hook.

In some embodiments, the cover has a pair of cover grooves, the pair of cover grooves being configured to be slidably supported by a pair of slide rails on the follower compartment.

In some embodiments, the cover has a raised cover stop ridge, that in cooperation with a cover stop groove in the follower compartment prevents the cover from moving beyond the cartridge-loading portion opening.

In some embodiments, the follower compartment has a magazine bottom cap which supports and protects the follower assembly.

In some embodiments, the extension portion, the cartridge-loading portion, the follower compartment, and the follower assembly are each made from at least one of: metal or plastic.

BRIEF DESCRIPTION OF THE DRAWINGS

The invention will be more fully understood from the following detailed description, in conjunction with the following figures, wherein.

DETAILED DESCRIPTION

Figure 1:
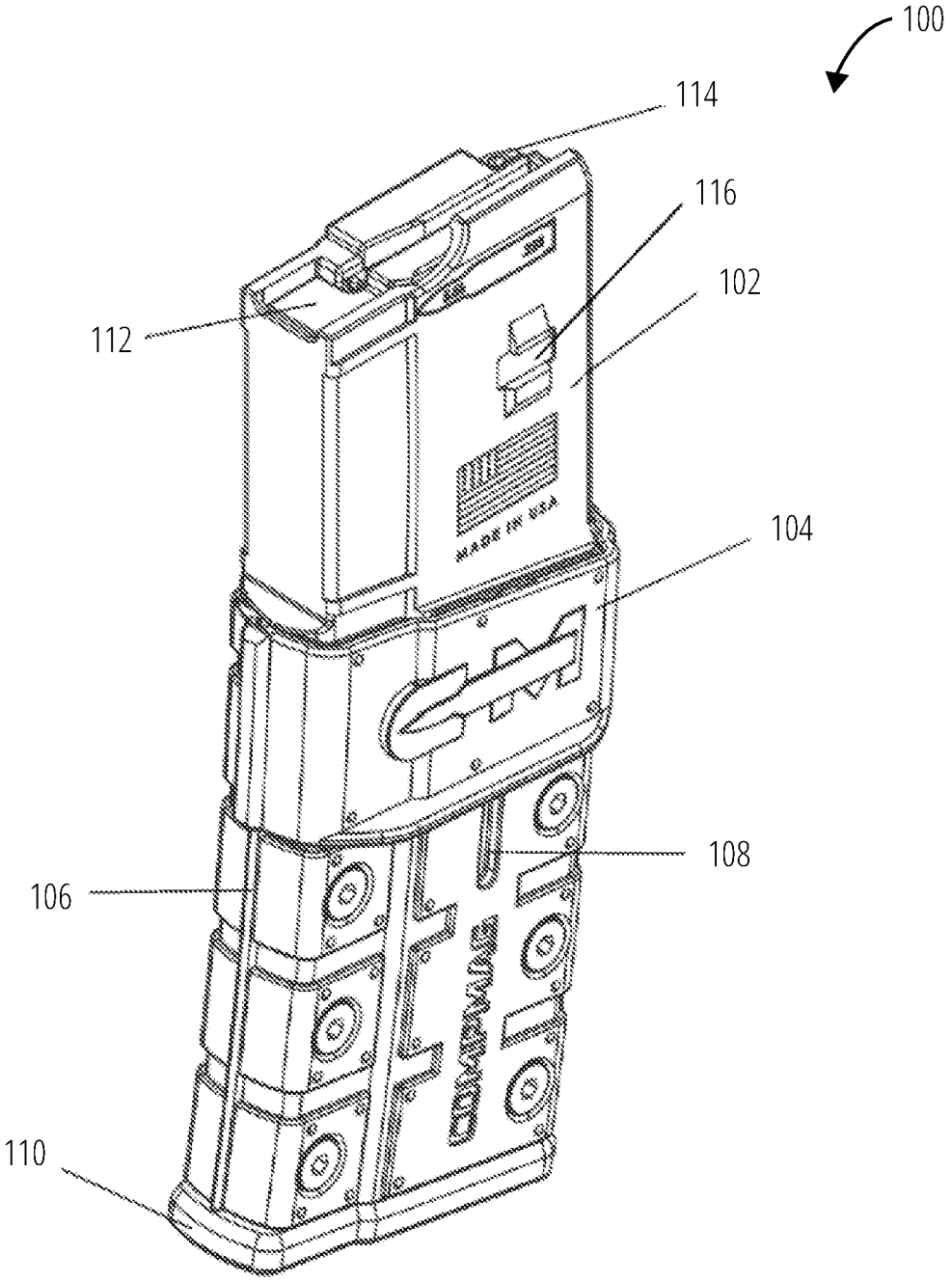
FIG. 1 is an external perspective view of the ammunition magazine with the cover in the closed position.

FIG. 1 shows an embodiment with the top of an extension portion 102 having a locking screw 114 which is used to securely attach an ammunition magazine 100 to a firearm's lower receiver, such that the ammunition magazine 100 can not be removed from the firearm without separating the upper receiver from the lower receiver;

This view shows that at the top of an ammunition magazine 100 is a follower top plate 112 which supports a stack of cartridges. On the upper side of an extension portion 102 is a magazine insertion grip 116 which snaps into a corresponding shape in the lower receiver when the ammunition magazine 100 is inserted into the lower receiver.

The cartridge-loading portion has a cover 104 which can be moved up or down along an at least one side rail 106. In this view, the cover 104 is in the up and closed position. The extent to which the cover 104 can be moved downward is limited by a cover stop groove 108.

At the bottom of the follower assembly is a magazine bottom cap 110 which forms the structural bottom of the follower assembly.

Figure 2:
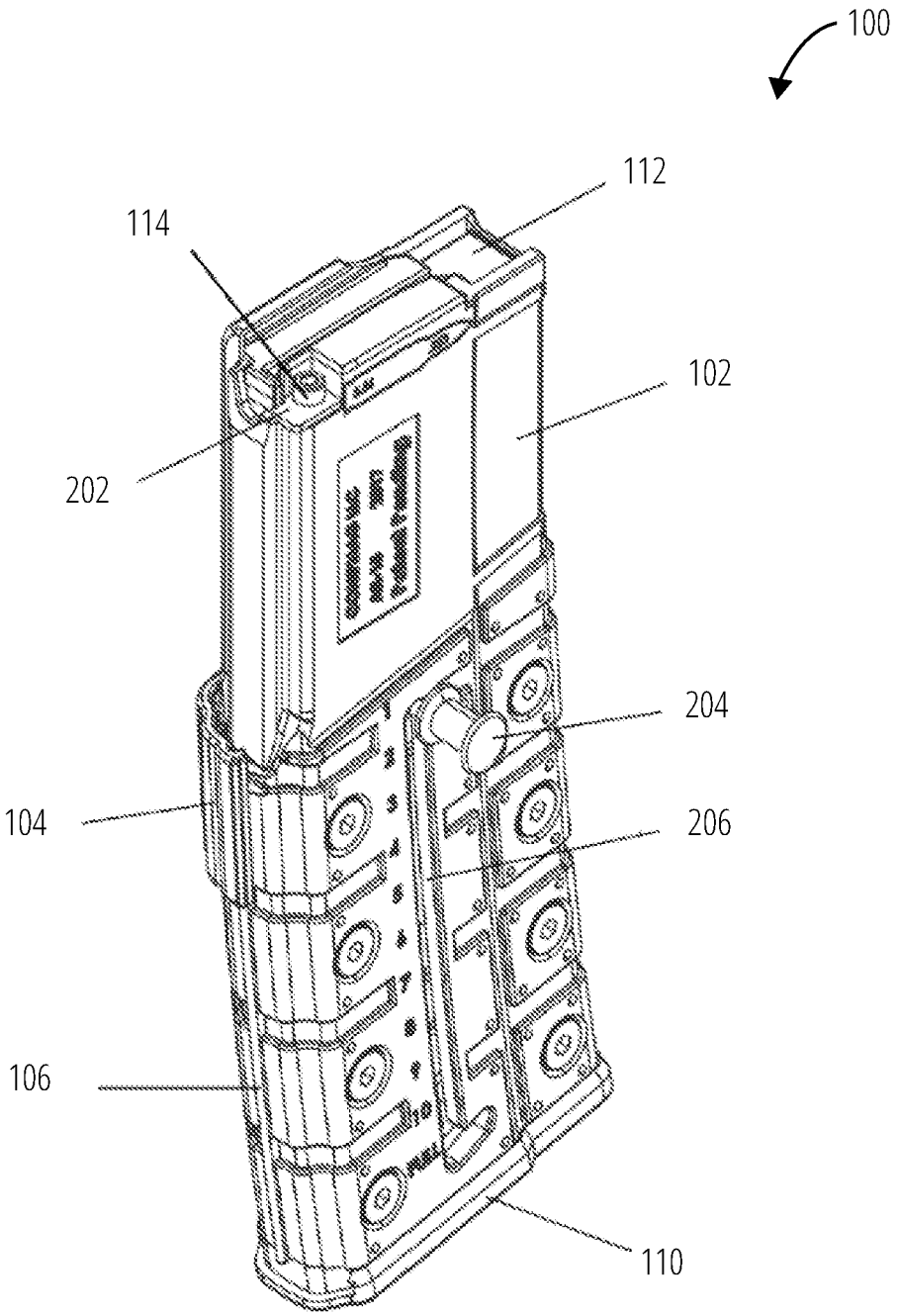
FIG. 2 is an external perspective view of the ammunition magazine with the movable finger-pull in the up position.

FIG. 2 shows the top of an extension portion 102 with a blocking assembly including a locking screw 114 and an attachable blocking tab 202 which are used to securely attach an ammunition magazine 100 to a firearm's lower receiver, such that the ammunition magazine cannot be removed from the firearm without separating the upper receiver from the lower receiver. The attachable blocking tab 202 is attached after insertion of the ammunition magazine 100 into the magazine well, and before re-engaging the upper receiver with the lower receiver. The attachable blocking tab 202 and locking screw 114 are shown in exploded relationship to the ammunition magazine 100 in FIG. 9.

Figure 9:
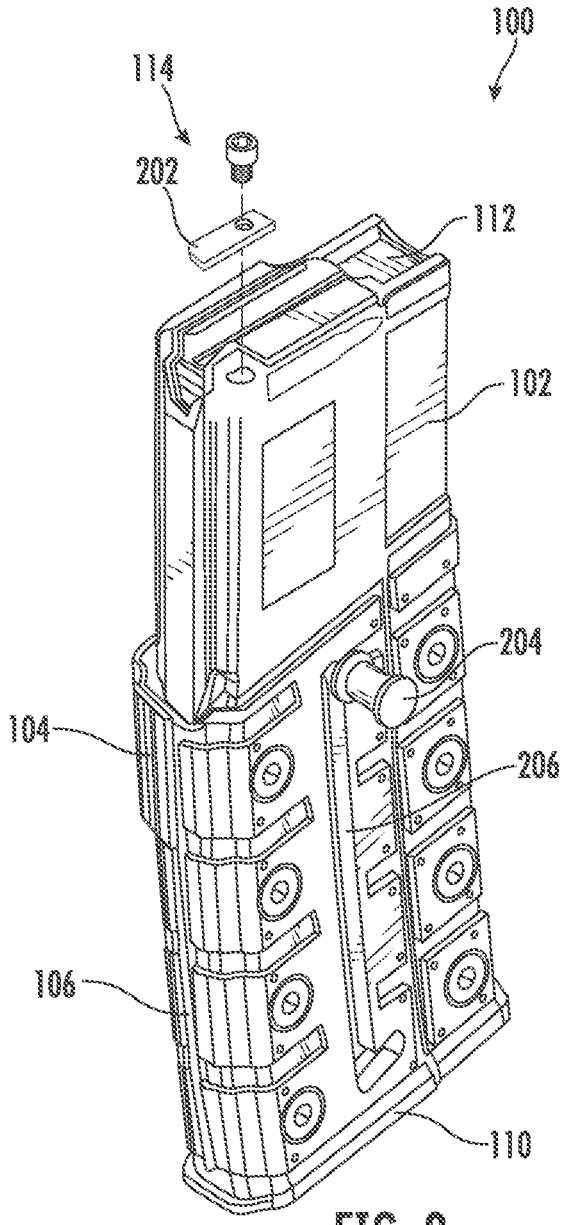
FIG. 9 is an external perspective view similar to FIG. 2, with the elements of the blocking assembly shown in exploded relationship to the magazine.

Also visible at the top of the ammunition magazine 100 of FIGS. 2 and 9 is a follower top plate 112 which supports a stack of cartridges.

This view shows one end of a cover 104 which can be moved up or down along an at least one side rail 106. The cover 104 is in the up and closed position.

Also shown is a finger-pull slot 206 along the side of the follower assembly. The finger-pull slot 206 guides the travel of a finger-pull 204 which controls the position of the follower top plate 112. In this view, the finger-pull 204 is in the topmost position within the finger-pull slot 206.

At the bottom of the follower assembly is a magazine bottom cap 110 which forms the structural bottom of the follower assembly.

Figure 3:
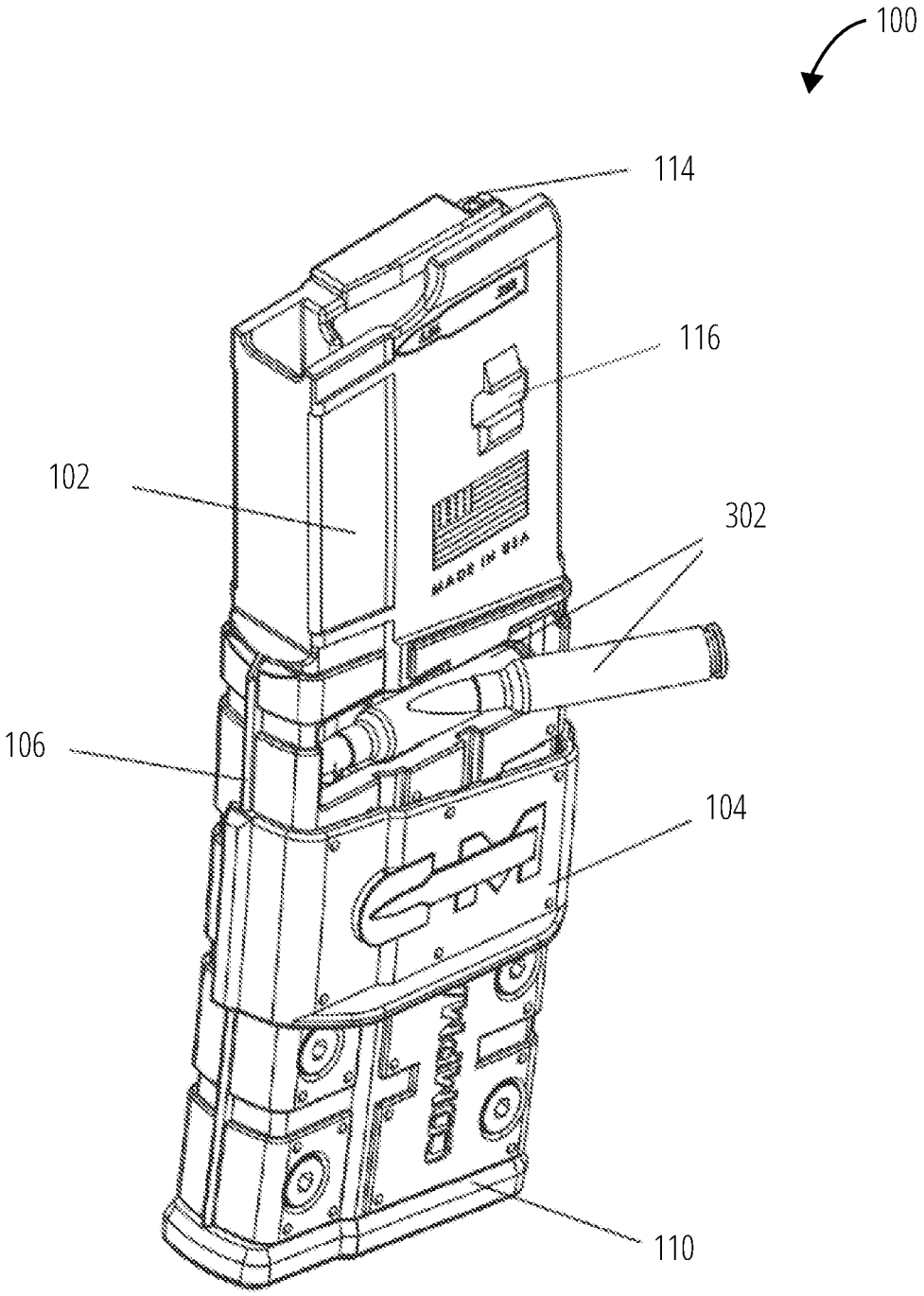
FIG. 3 is a perspective view of the ammunition magazine with the cover in the open position, showing cartridges being added to the stack of cartridges.

FIG. 3 shows the top of an extension portion 102 with a blocking assembly including a locking screw 114 and the attachable blocking tab 202 which are used to securely attach an ammunition magazine 100 to a firearm's lower receiver. On the upper side of the extension portion 102 is a magazine insertion grip 116 which snaps into a corresponding shape in the lower receiver when the ammunition magazine 100 is inserted into the lower receiver.

This view shows a cover 104 in the down position on at least one side rail 106. The cover 104 is in an open position, showing the insertion of a stack of cartridges 302. At the bottom of the follower assembly is a magazine bottom cap 110 which forms the structural bottom of the follower assembly.

Figure 4:
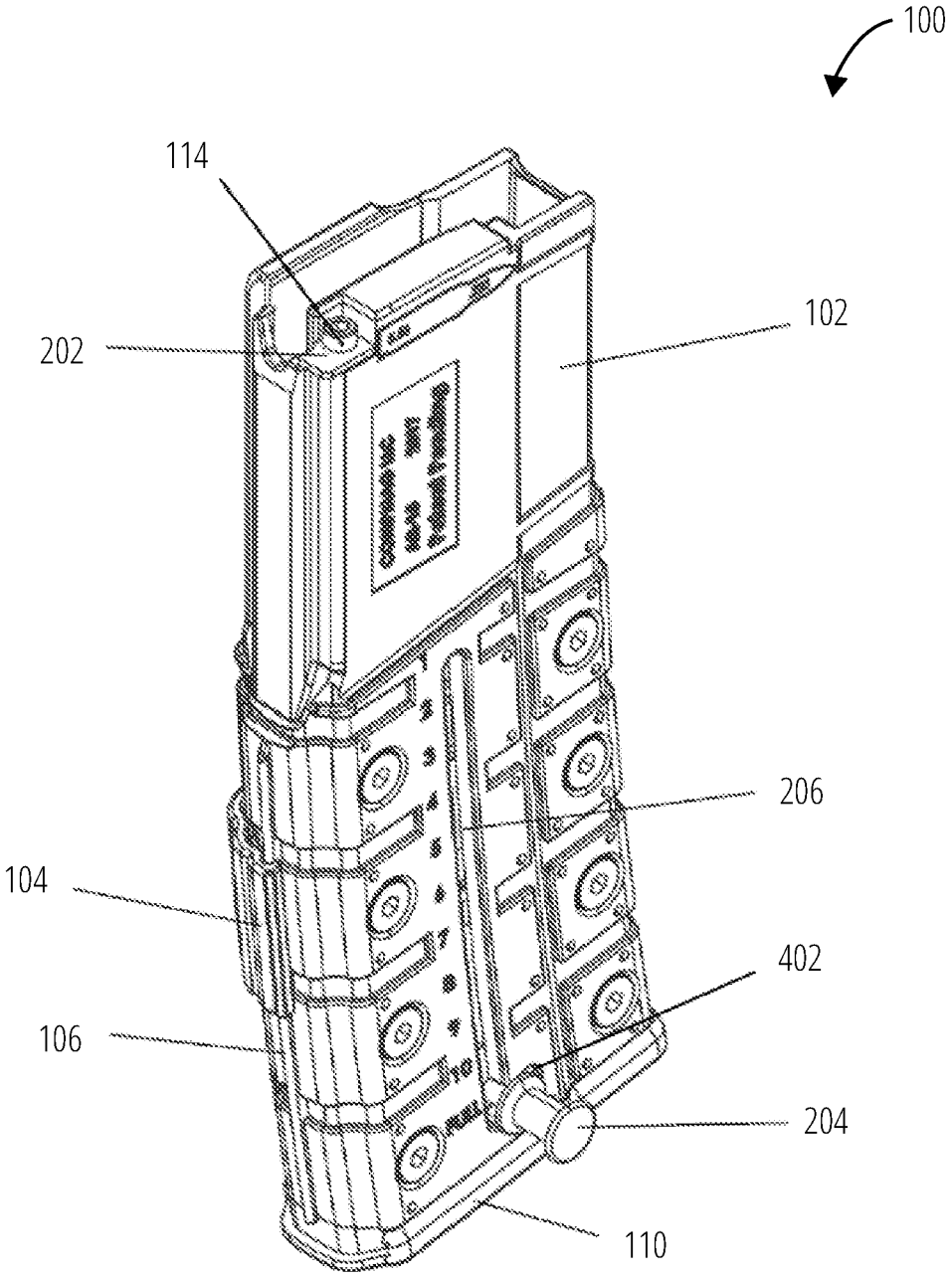
FIG. 4 is an external perspective view of the ammunition magazine with the movable finger-pull in the finger-pull slot.

FIG. 4 shows the top of an extension portion 102 with a blocking assembly including a locking screw 114 and an attachable blocking tab 202 which are used to securely attach an ammunition magazine 100 to a firearm's lower receiver.

This view shows one end of a cover 104 which can be moved up or down along an at least one side rail 106. The cover 104 is in the down and open position. Also shown is a finger-pull slot 206 along the side of the follower compartment. The finger-pull slot 206 guides the travel of a finger-pull 204. In this view, the finger-pull 204 is in the bottom hook 402 within the finger-pull slot 206.

At the bottom of the follower assembly is a magazine bottom cap 110 which forms the structural bottom of the follower assembly.

Figure 5:
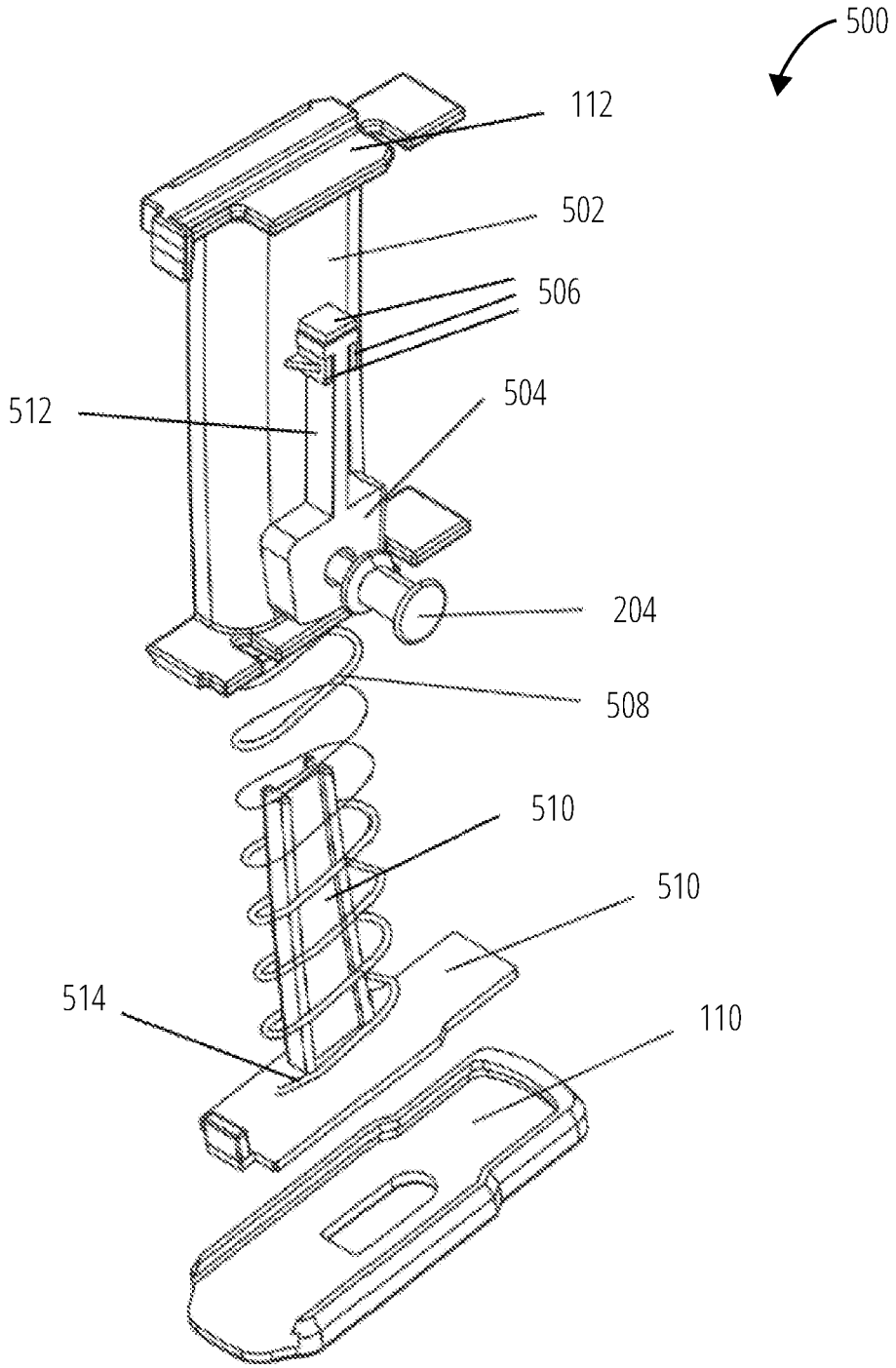
FIG. 5 is an exploded front view of the follower assembly and the magazine bottom cap.

FIG. 5 shows the top of a follower 502 is a follower top plate 112 which supports a stack of cartridges. A follower arm 504 provides a fixed attachment point at the lower end of the follower arm 504 for a finger-pull 204. The finger-pull 204 slides up and down along the finger-pull slot in one of the magazine side walls, the finger-pull 204 will change position as it enters the bottom hook.

To allow the finger-pull 204 to change in position into the finger-pull slot's bottom hook, a follower arm T-mount 506 provides flexible attachment points for the top of the follower arm 504. In addition, the follower arm flexible stem 512 is thin and flexible so that the finger-pull 204 can move flexibly within the finger-pull slot's bottom hook.

A follower assembly 500 includes a spring 508 to push up the follower 502, and thereby securely push the stack of cartridges up inside the magazine cavity. A spring guide 510 is configured to provide support for a spring lower end 514 and to provide alignment for the spring 508 when in an extended position and when in a compressed position, with the spring guide 510 having a shape that fits inside the follower 502 when the spring 508 is in the compressed position;

A magazine bottom cap 110 supports the spring guide 510, in addition to forming the structural bottom of the follower assembly.

Figure 6:
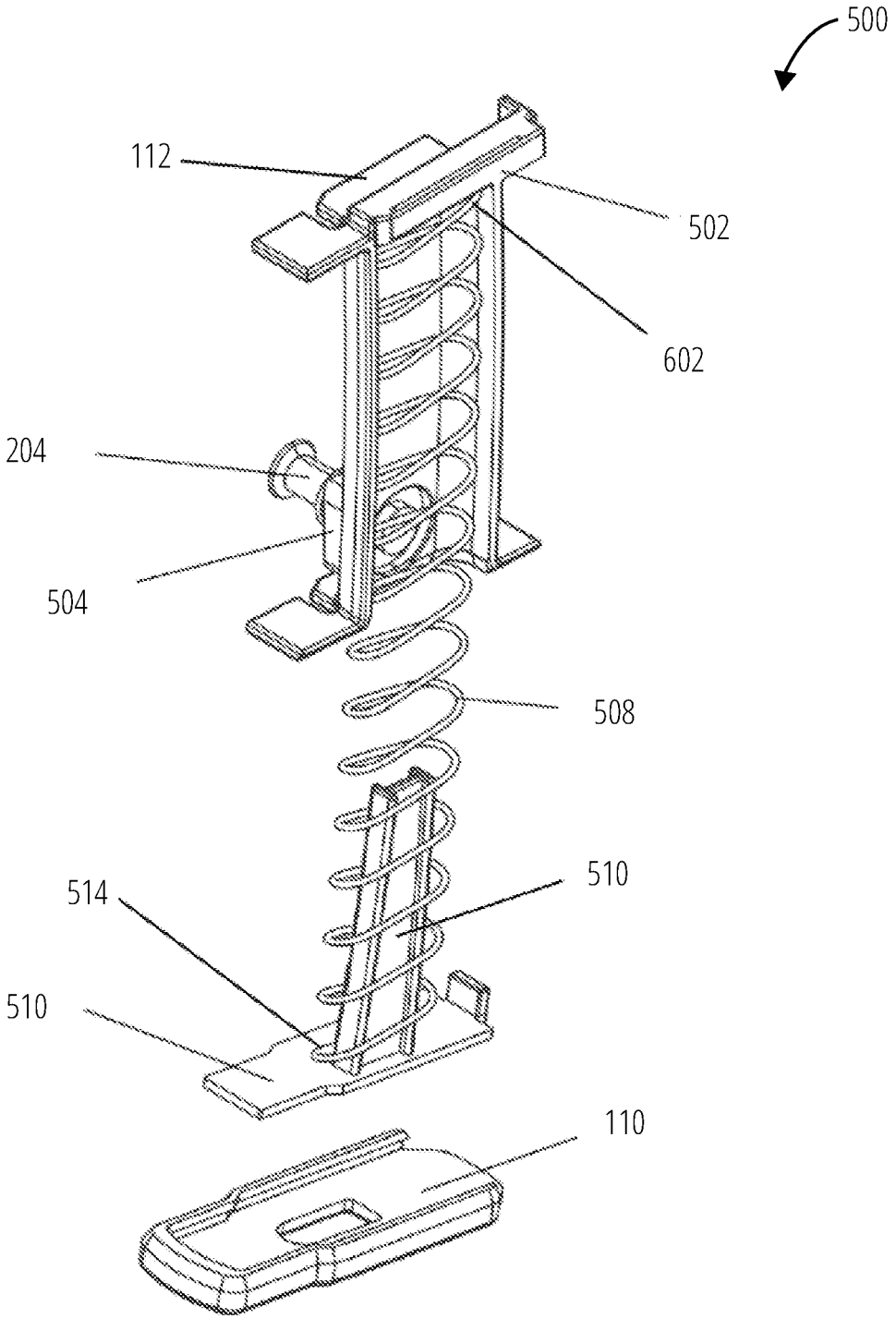
FIG. 6 is an exploded rear view of the follower assembly and the magazine bottom cap.

FIG. 6 shows that the top of a follower 502 has a follower top plate 112 which supports a stack of cartridges. A follower arm 504 provides a fixed attachment point at the lower end of the follower arm 504 for a finger-pull 204. The finger-pull 204 slides up and down along a finger-pull slot in one of the magazine side walls.

A follower assembly 500 includes a spring 508. A spring upper end 602 is configured to push up the follower 502, and thereby securely push the stack of cartridges up inside the magazine cavity. A spring guide 510 is configured to provide support for a spring lower end 514 and to provide alignment for the spring 508 when in an extended position and when in a compressed position, with the spring guide 510 having a shape that fits inside the follower 502 when the spring 508 is in the compressed position; A magazine bottom cap 110 supports the spring guide 510, in addition to forming the structural bottom of the follower assembly.

Figure 7:
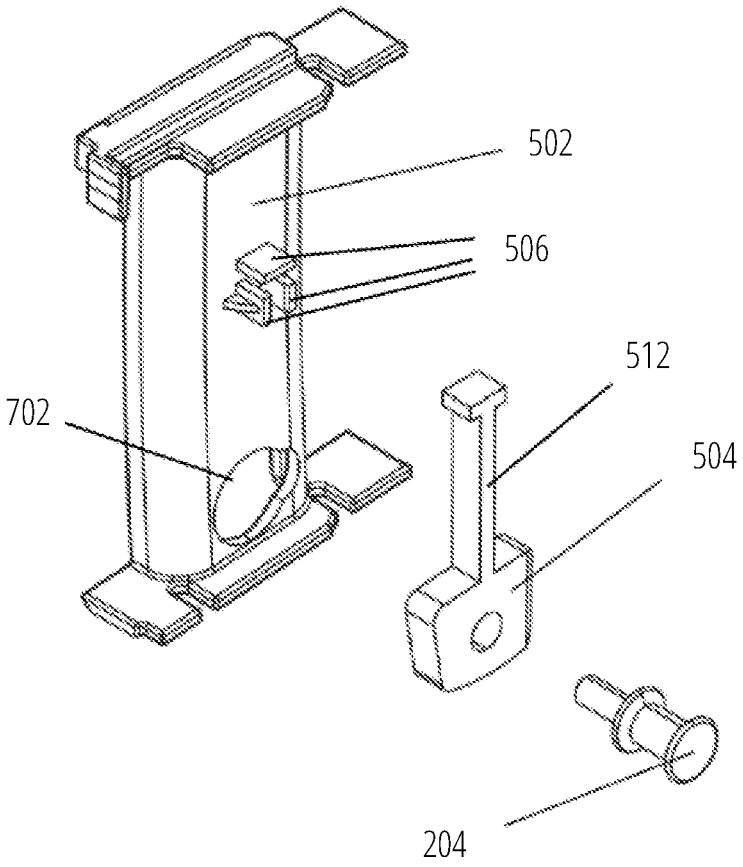
FIG. 7 is an exploded view of the follower, the follower arm, and the movable finger-pull.

FIG. 7 shows a follower arm 504 which provides a fixed attachment point at the lower end of the follower arm 504 for a finger-pull 204. The finger-pull 204 slides up and down along the finger-pull slot in one of the one of the follower compartment side walls, and the finger-pull 204 will change horizontal position as it enters the bottom hook.

To allow the finger-pull 204 to change in position into the finger-pull slot's bottom hook, the follower 502 includes a follower arm T-mount 506 which provides flexible attachment points for the top of the follower arm 504. In addition, a follower arm flexible stem 512 is thin and flexible so that the finger-pull 204 can move flexibly within the finger-pull slot's bottom hook.

A movable finger-pull cutout 702 provides and open cutout to allow the follower arm 504 to move horizontally, and to allow the finger-pull 204 to move flexibly within the finger-pull slot's bottom hook.

Figure 8:
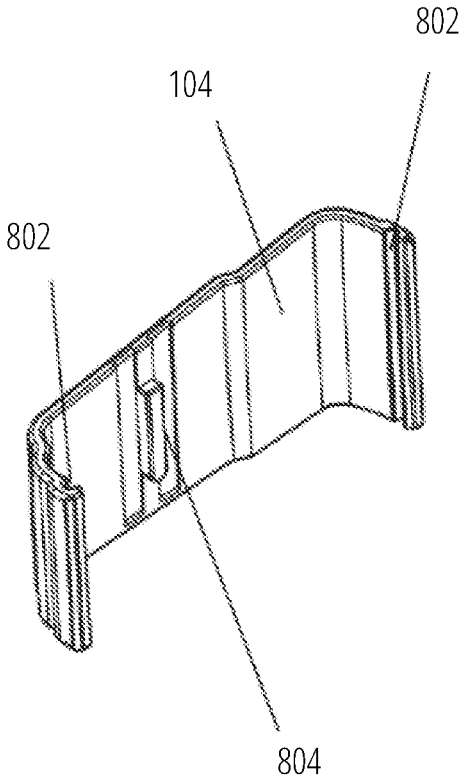
FIG. 8 is an inside perspective view of the cover.

FIG. 8 shows a cover 104 which has a raised cover stop ridge 804, that in cooperation with a cover stop groove in one of the pair of magazine side walls prevents the top of the cover 104 from moving beyond the panel opening bottom.

In this embodiment, also shown are a pair of cover grooves 802 which fit over a pair of side rails that are on the pair of magazine side ends, and which slidably support the cover 104.

Installing the Fixed Magazine

To install the fixed magazine 100 on the firearm, the upper receiver is first separated from the lower receiver 900. Once the top of the lower receiver 900 is exposed, the fixed magazine 100 of the invention is inserted up into the magazine well 902.

Figure 10:
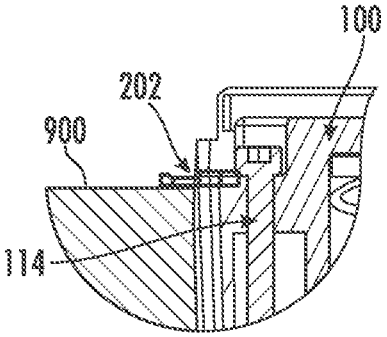
FIG. 10 is a sectional view showing the blocking assembly positioned in the magazine.c1

In one embodiment of the invention, a blocking tab 202 is then placed over the top of the fixed magazine 100 such that the blocking tab 202 overlaps a portion of the upper side of the lower receiver 900. The blocking tab 202 is then attached to the fixed magazine 100 using a screw 114 which fixes the tab 202 to the lower receiver 900 and the fixed magazine 100, as shown in FIG. 10, so that the fixed magazine 100 cannot be removed from the firearm without separating the upper receiver and the lower receiver 900.

Loading the Magazine

Because the magazine is fixed to the firearm, the magazine cannot be loaded from the top of the fixed magazine. Instead, a side-loading method is used. A sliding cover located on one side of the magazine is opened to allow the magazine to be side-loaded with cartridges.

In addition, to load the magazine, one uses a finger-pull located in a slot on one side of the magazine to retract the spring-loaded cartridge follower. Having the finger-pull on one side of the magazine allows one to conveniently grip the other side of the magazine with one's other hand while retracting the cartridge follower.

During the loading process, the finger-pull is pulled down along a slot in the side of the magazine. The finger-pull is locked in the down position by moving the finger-pull into a bottom hook, located at the bottom of the finger-pull slot. When the finger-pull is in the down and hooked position, the magazine spring is compressed, and the cartridge follower is locked in the down position.

The cover on the side of the magazine is then opened by sliding the cover down, which reveals the cartridge opening. This also reveals the cartridge cavity in the upper part of the magazine, providing space for loading the stack of ammunition cartridges. Once this cavity is opened, the user can easily load ammunition cartridges into the cavity in the upper extension portion of the magazine.

Once the stack of cartridges is loaded, the cover is closed by sliding it upwards, and the finger-pull is unhooked from the bottom hook. Once the finger-pull is released from the bottom hook, the cartridge follower pushes up against the stack of cartridges, allowing the magazine and the firearm to work normally.

Other modifications and implementations will occur to those skilled in the art without departing from the spirit and the scope of the invention as claimed. Accordingly, the above description is not intended to limit the invention, except as indicated in the following claims.

What is claimed is:

1. An ammunition magazine and a firearm having a receiver capable of being disassembled to attach the magazine from inside the firearm, the receiver having an opening for receiving the ammunition magazine, the ammunition magazine comprising:

an extension portion configured to contain a stack of cartridges, the extension portion having a loading end and a feeding end;

a cartridge-loading portion configured to accept a sequence of cartridges for loading into the extension portion, the cartridge-loading portion including: a first sidewall, a second sidewall opposite the second sidewall, an opening for receiving the cartridges defined by the first sidewall, and a cover configured to alternately cover or reveal the opening;

a follower compartment including: a finger-pull slot defined by the second sidewall and a finger-pull cutout offset from the finger-pull slot that provides a bottom hook; and a follower assembly including: a follower, a finger-pull attached to the follower, the finger-pull extending through the finger-pull slot, the finger-pull being moveable when the finger-pull is engaged with the bottom hook, and a spring configured to be compressed by the follower when the finger-pull is engaged with the bottom hook, and configured to expand when the finger-pull is disengaged from the bottom hook, thereby allowing the follower to urge the stack of cartridges toward the feeding end of the extension portion; and a blocking assembly configured to allow the ammunition magazine to be detachably secured to the receiver when the receiver is disassembled and to prevent removal of the ammunition magazine from the receiver when the receiver is assembled, wherein the blocking assembly comprises:

an attachable blocking tab at the feeding end of the extension portion, wherein the attachable blocking tab is configured to overlap a portion of the receiver and to prevent removal of the ammunition magazine from the magazine well while the receiver is assembled, and a screw that affixes the blocking tab to the receiver and the extension portion.

2. The ammunition magazine of claim 1, wherein the extension portion is configured to limit capacity of the ammunition magazine to no more than ten cartridges.

3. The ammunition magazine of claim 1, wherein the follower assembly comprises:

a spring guide, configured to provide support and stability for the spring and to provide alignment for the spring when in an extended position and when in a compressed position, the spring guide having a shape that fits inside the follower when the spring is in the compressed position; and a follower arm, fixedly attached to the finger-pull, with the follower arm also configured to attach to the follower, so as to allow movement of the finger-pull into the bottom hook.

4. The ammunition magazine of claim 1, wherein the cover has a pair of cover grooves, the pair of cover grooves being configured to be slidably supported by a pair of slide rails on the follower compartment.

5. The ammunition magazine of claim 1, wherein the cover has a raised cover stop ridge, that in cooperation with a cover stop groove in the follower compartment prevents the cover from moving beyond the cartridge-loading portion opening.

6. The ammunition magazine of claim 1, wherein the follower compartment has a magazine bottom cap which supports and protects the follower assembly.

7. The ammunition magazine of claim 1, wherein the extension portion, the cartridge-loading portion, the follower compartment, and the follower assembly are each made from at least one of: metal or plastic.

8. An ammunition magazine and a firearm having a receiver capable of being disassembled, the receiver having an opening for receiving the ammunition magazine, the ammunition magazine comprising:

an extension portion configured to contain a stack of cartridges, the extension portion having a loading end and a feeding end, the extension portion including an attachable blocking tab at the feeding end for blocking removal of the ammunition magazine from the receiver, the attachable blocking tab being adapted to overlap a portion of the receiver;

a screw that affixes the blocking tab to the receiver and the extension portion;

a cartridge loading portion configured to accept a sequence of cartridges for loading into the extension portion, the cartridge-loading portion including: a first sidewall, a second sidewall opposite the first sidewall, and an opening defined by the first sidewall adapted to receive the cartridges being loaded in the extension portion; and a follower compartment including: a finger-pull slot defined by the second sidewall and a finger-pull cutout offset from the finger-pull slot that provides a bottom hook.

9. The ammunition magazine of claim 8 further comprising: a follower assembly including: a follower, a finger-pull attached to the follower, the finger-pull extending through the finger-pull slot, the finger-pull being movable when released from the bottom hook, and a spring configured to be compressed by the follower when the finger-pull is engaged with the bottom hook, thereby allowing the follower to urge the stack of cartridges towards the feeding end of the ammunition magazine.

10. The ammunition magazine of claim 9 wherein the spring includes a spring upper end configured to push the follower and the stack of cartridges up, a spring lower end opposite the spring upper end, a spring guide for supporting the spring lower end and to provide alignment for the spring when in an extended position and when in a compressed position, the spring guide configured to fit the follower when the spring is in the compressed position.

11. The ammunition magazine of claim 10 further comprising a magazine bottom cap attached to the spring guide and forming a structural bottom of the follower assembly.

12. The ammunition magazine of claim 8, wherein the cover has a pair of cover grooves, the pair of cover grooves being configured to be slidably supported by a pair of slide rails on the follower compartment.

13. The ammunition magazine of claim 8, wherein the cover has a raised cover stop ridge, that in cooperation with a cover stop groove in the follower compartment prevents the cover from moving beyond the cartridge-loading portion opening.

14. The ammunition magazine of claim 1, wherein the screw affixes the blocking tab to the receiver at a location that is not accessible when the upper receiver is engaged with the receiver.

15. The ammunition magazine of claim 8, wherein the screw affixes the blocking tab to the receiver at a location that is not accessible when the receiver is assembled.

* * * * *